US007135094B2

(12) United States Patent
Watanabe et al.

(10) Patent No.: US 7,135,094 B2
(45) Date of Patent: Nov. 14, 2006

(54) PAPERMAKING PRESS FELT

(75) Inventors: Kazumasa Watanabe, Tokyo (JP); Hirokuni Ohno, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 554 days.

(21) Appl. No.: 10/610,180

(22) Filed: Jun. 30, 2003

(65) Prior Publication Data

US 2004/0026058 A1 Feb. 12, 2004

(30) Foreign Application Priority Data

Jul. 4, 2002 (JP) ..... 2002-195864

(51) Int. Cl.

| | |
|---|---|
| ***D21F 7/08*** | (2006.01) |
| ***D21F 7/12*** | (2006.01) |
| ***B32B 3/02*** | (2006.01) |
| *B32B 5/06* | (2006.01) |

(52) U.S. Cl. ..... 162/358.2; 162/900; 162/904; 428/58; 442/186; 442/270

(58) Field of Classification Search ..... 162/358.1, 162/358.2, 348, 900–904, 204–207; 442/185, 442/186, 240, 270–275, 381, 388, 402; 428/57, 428/58; 28/110, 142; 139/383 A, 425 A
See application file for complete search history.

(56) References Cited

U.S. PATENT DOCUMENTS

| | | | | |
|---|---|---|---|---|
| 3,323,226 | A * | 6/1967 | Christie et al. | 34/95 |
| 4,369,081 | A * | 1/1983 | Curry et al. | 156/148 |
| 4,842,925 | A * | 6/1989 | Dufour et al. | 428/223 |
| 5,202,170 | A * | 4/1993 | Hsu et al. | 428/48 |
| 6,124,015 | A * | 9/2000 | Baker et al. | 428/99 |
| 6,240,608 | B1 * | 6/2001 | Paquin et al. | 28/142 |

* cited by examiner

*Primary Examiner*—Eric Hug
(74) *Attorney, Agent, or Firm*—Howson and Howson

(57) ABSTRACT

An endless papermaking press felt comprises a base and a batt layer intertwiningly integrated with the base. The batt layer comprises a wet paper web side layer and a machine side layer formed on an outer surface and inner surface of a base respectively, The base is manufactured from belt-shaped partial base bodies, which are connected to one another in side-by-side relationship. The press felt can be manufactured easily and at reduced cost.

3 Claims, 10 Drawing Sheets

PAPERMAKING PRESS FELT

FIELD OF THE INVENTION

This invention relates to papermaking press felts, and more particularly to improvements by which the process of manufacturing papermaking press felts is simplified, and their manufacturing cost is reduced.

BACKGROUND OF THE INVENTION

Conventionally, a felt is used in the press part of a papermaking machine to remove water from a wet paper web. The press part generally comprises a pair of press rolls, or a press roll and a shoe having a surface which conforms with the surface of the press roll. As the felt and wet paper web pass together through the press part, water is transferred to the felt, and thus removed from the wet paper web.

The structure of a conventional press felt is depicted in FIG. 1. The felt 10 comprises a base 20 and a batt layer 30, the base and batt layers being intertwined with each other and thereby integrated. The base 20 is indispensable for imparting strength to the whole felt. An endless woven fabric having a warp and weft is normally used for the base 20.

In the manufacture of the felt 10, an endless, woven base 20, which has almost the same width as the finished felt, is produced in the desired length. Generally, the warp and weft are double woven by a weaving machine to produce an endless base fabric. Alternatively, after weaving a fabric having ends, both ends are sewn together to produce an endless woven fabric. After the base 20 is manufactured, a batt fiber is arranged on the base, and the batt fiber is intertwined with the base by needle punching to produce the finished felt 10.

A felt having the above-described structure needs to be produced in number of different sizes, since the press parts of papermaking machines have various sizes and structures. Weaving base fabrics of various sizes using a weaving machine requires a lot of time and manpower, and it is very difficult to simplify the process and reduce cost.

One approach to solving this problem was a manufacturing method in which a belt-shaped body narrower than the finished felt was first produced, and then wound in a spiral. This approach, which is disclosed in Unexamined PCT National Phase Publication 503385/1994, is illustrated in FIG. 2.

In the approach illustrated in FIG. 2, a belt-shaped body 23 is formed from a thread material selected according to the desired performance of the finished felt. The distance between a pair of guide rolls GR is adjusted according to the desired length of the finished felt. As the guide rolls GR are driven, the belt-shaped body 23 is wound onto both guide rolls. The angle relative to guide rolls GR, at which the belt-shaped body is wound, is adjusted so that the belt-shaped body 23 is wound in a spiral, with the windings in edge-to-edge relationship. The winding operation continues until the total width of the wound belt-shaped body 23 reaches the desired width of the finished felt. Afterward, the adjacent edges of the spiral belt-shaped body 23 are integrally bonded, typically by sewing or by deposition of an adhesive, to produce an endless base 20. Finally, a batt layer is formed on the base 20, to produce the finished papermaking press felt.

A problem with the technology illustrated in FIG. 2 is that, the angle at which a belt-shaped body is wound is not easily controlled. When the angle is incorrect, the sides of the windings may not be in adjacent relationship, making it difficult to carry out the bonding operation. In addition, when the edges of the windings are separate from each other, adequate bond strength may not be obtained. Moreover, the gaps between the windings produce irregularities in the felt surface, which are transferred to a wet paper web in the papermaking process.

The object of the invention is to provide a papermaking press felt which avoids the above-described problems, and which can be manufactured easily and less expensively.

SUMMARY OF THE INVENTION

According to the invention, in an endless papermaking press felt comprising a base and a batt layer is integrated with the base, the base comprises a plurality of partial base bodies, each partial base body being in the form of a closed loop and having a width narrower than the width of the press felt, the partial base bodies being disposed in side-by-side relationship with adjoining sides, and said adjoining sides being connected.

Each partial base body may be composed of a wound, belt-shaped body, and may be composed of a belt-shaped body having ends which are integrally bonded to each other. Optionally Each partial base body may be composed of a plurality of belt-shaped bodies in overlying relationship.

Where each partial base body comprises a plurality of belt-shaped bodies in overlying relationship, and each of the belt-shaped bodies has ends which are integrally bonded to each other in an end area, the end areas of the respective belt-shaped bodies are preferably offset from one another in the direction of the perimeter of the partial base body.

The adjoining sides of partial base bodies may be connected by a sewn thread composed of water-soluble fiber or by needling of the batt layer to both of the partial base bodies.

Each partial base body is in the form of a loop formed from a belt-like element the ends of which are integrally bonded to each other in an end area. These ends may be connected by a sewn thread composed of water-soluble fiber.

The end area may disposed at an acute angle relative to the cross machine direction, and the end areas of the respective partial base bodies may be offset from one another in the machine direction.

The press felt may be composed of at least one intermediate partial base body and side partial base bodies disposed along the sides of the base. In this case, the end area of the intermediate base body is preferably located in front of the end areas of both of the side partial base bodies relative to a machine direction.

The end areas of the partial base bodies may be disposed at acute angles relative to the cross machine direction, and in this case, front sections of the end areas are preferably offset from one another in the machine direction.

Where the side partial base bodies have angled end areas, the front sections of the end areas of both side partial base bodies are preferably located inboard of the base.

With this invention, a papermaking press felt of a desired size may be manufactured in a relatively short time, and with little manpower, since the base is formed by integrating partial base bodies in side-by-side relationship. In addition, since partial base bodies are lined up in the machine direction, rather than in a spiral at an angle relative to the machine direction as in the conventional case, separation of partial base bodies, lowering of bond strength, which accompanied separation, and resulting transfer of irregularities to a wet paper web, may be prevented.

DETAILED DESCRIPTION OF THE PREFERRED EMBODIMENTS

Figure 1:
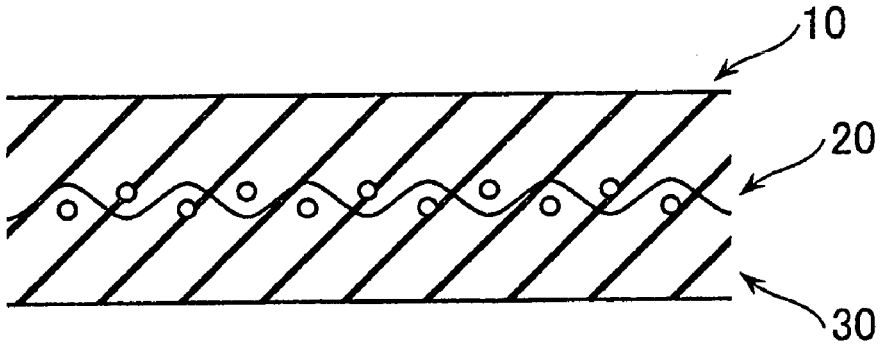
FIG. 1 is a cross-sectional view of a papermaking press felt.
Figure 2:
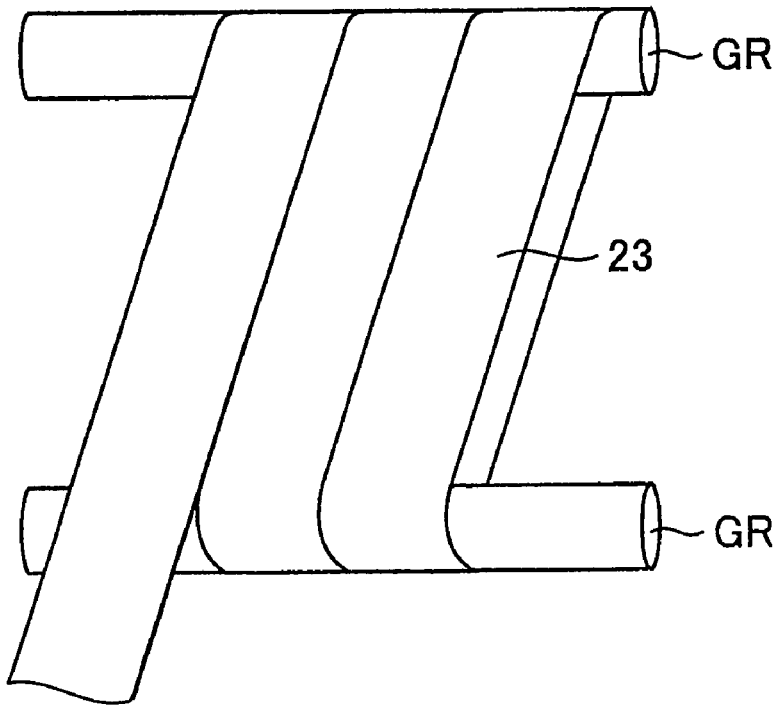
FIG. 2 is a schematic view illustrating a method for manufacturing a conventional papermaking press felt.
Figure 3:
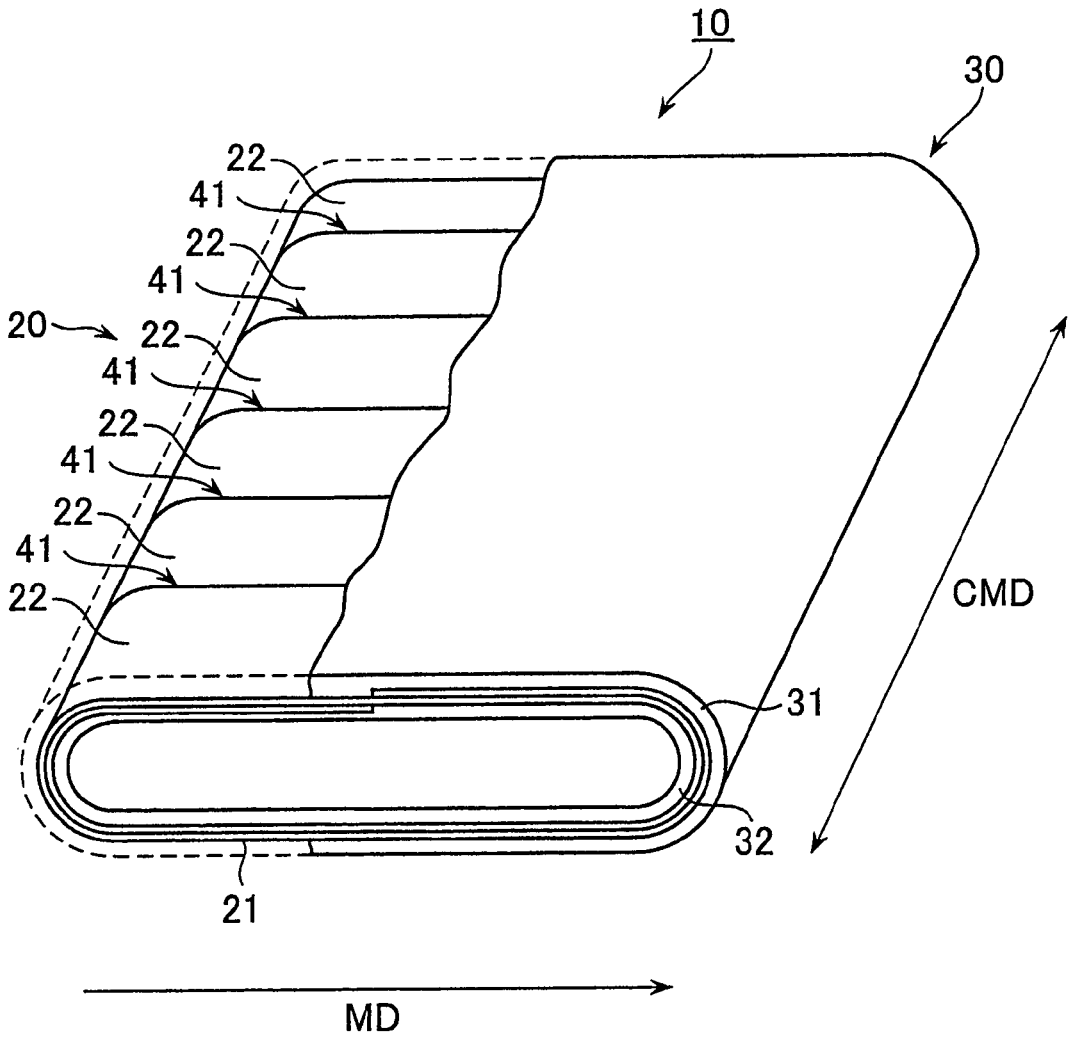
FIG. 3 is a perspective view of a papermaking press felt according to the invention.

The felt 10, shown in FIG. 3, comprises an endless base 20 and a batt layer 30, intertwined, and thereby integrated with each other. The batt layer 30 comprises a web side 31 for contact with a wet paper web and a machine side 32 for contact with a press roll shoe of a papermaking machine. These sides 31 and 32 of the batt layer are formed on the outer surface and inner surface of the endless base 20 respectively.

The base 20 is manufactured by lining up partial base bodies 22, each comprising a belt-shaped body 21 and connecting the sides 41 of the partial bases. In FIG. 3, the arrow MD refers to the machine direction, i.e., the direction of travel of the papermaking press felt, and arrow CMD refers to the cross-machine direction, i.e., the direction perpendicular to the machine direction.

In the explanations below, it is assumed that the belt-shaped body 21 comprises a woven fabric having a warp and weft. The machine direction MD, and cross machine direction CMD correspond respectively to the directions of the warp and weft of the belt-shaped body 21. However, the belt-shaped body 21 is not limited to this woven structure. Other structures may also be used, for example, a knitted fabric, or a structure in which a thread material is pinched by a film, as disclosed in Unexamined Japanese Patent Publication 209290/1997. In any case, any structure may be adopted as long as the belt-shaped body 21 is narrower in width than the finished felt, and can impart strength to the felt when formed into a base 20.

A method of manufacturing a papermaking press felt according to the invention will be explained below. First, methods of manufacturing a partial base used to form the base of the press felt will be explained referring to FIGS. 4-12.

Figure 4:
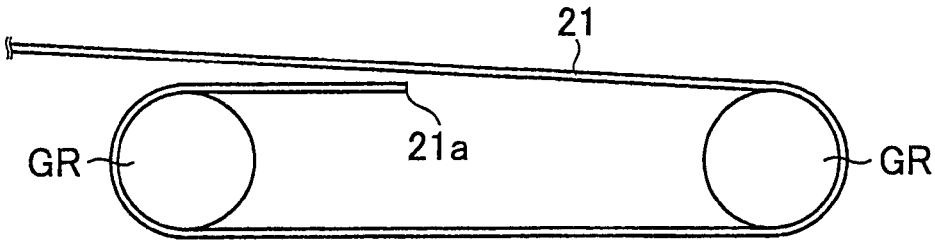
FIGS. 4–8 are schematic views illustrating a method of forming a partial base of a papermaking press felt in accordance with one embodiment of the invention.
Figure 5:
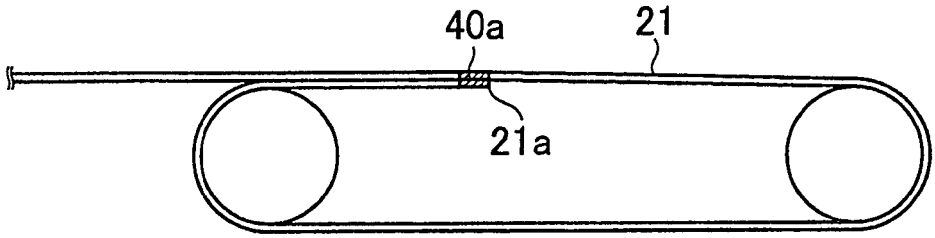

A belt-shaped body 21 comprises a woven fabric having a width narrower than that of the finished felt, and is wound by a winding apparatus (not shown). The distance between a pair of guide rolls GR is adjusted according to the desired length of the finished felt. As a first step, a belt-shaped body 21 is unwound from a supply on a winding apparatus (not shown), and wound onto guide rolls GR. As shown in FIG. 4, the unwound belt-shaped body 21 is wound once around both guide rolls GR. As shown in FIG. 5, a first end 21*a* is integrally bonded to the belt-shaped body 21 at a location 40*a*.

Various means may be adopted to bond the end to the belt-shaped body at location 40*a*. For example, the bonding can be carried out by sewing, using a thread composed of water-soluble fiber. When the finished felt is exposed to a large quantity of water the water-soluble fiber dissolves, the fibers used for sewing disappear, and the physical properties of the belt-shaped body at the bonding location 40*a* become similar to the physical properties of the other portions of the belt-shaped body. In this case, even though the water-soluble fiber dissolves, bonding at location 40*a* is maintained because the ends of the belt-shaped body are integrally bonded through the batt fiber by needling when the batt fiber is integrated with the base. Therefore, even after the water-soluble fiber is dissolved, the ends of a belt-shaped body do not peeled off, and adequate strength is maintained in the base.

A fiber which is dissolved at room temperature, or a fiber which is dissolved in warm water, such as PVA (polyvinyl alcohol) etc., may be used as the water-soluble fiber. Although for many applications, a water-soluble fiber is preferred, the belt-shaped body can also be sewn using an insoluble fiber, or bonded by the deposition of adhesive at bonding location 40*a*.

Figure 6:
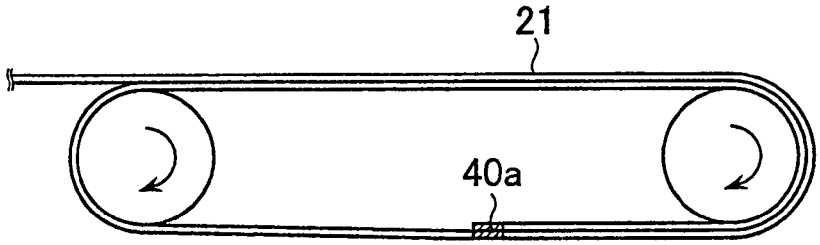
Figure 7:
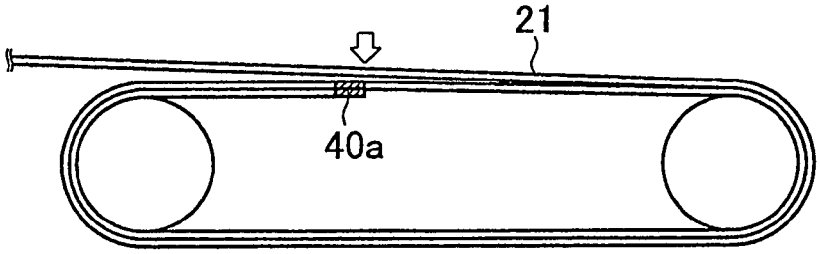
Figure 8:
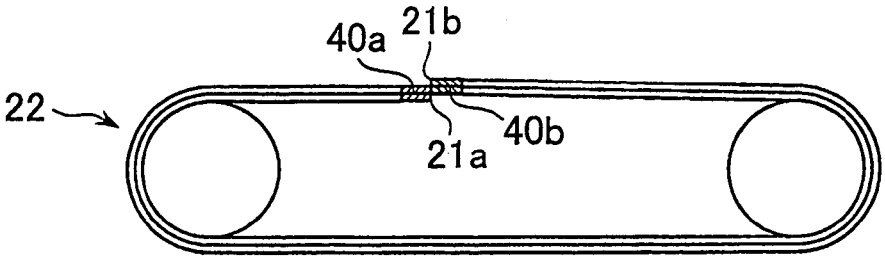

After one end of the belt-shaped body is bonded at location 40*a*, the guide rollers GR are again driven as shown in FIG. 6. When the guide rollers GR are driven, the belt-shaped body 21 from the supply winding apparatus continues to be wound, as one or more additional layers. The guide rollers GR are driven until the desired number of layers is achieved, at which point, the guide rollers are stopped, as shown in FIG. 7. While tension is applied to the portion of the belt-shaped body 21 extending between the supply and the guide rolls GR, the outer layer of the belt-shaped body, in this case the top layer as shown in FIG. 7, is integrally bonded to the already wound part of the belt-shaped body 21 at a bonding location 40*b* near the first end 21*a*, as shown in FIG. 8. The same bonding means as used at location 40*a* may be used at bonding location 40*b*. Thereafter, the belt-shaped body 21 is cut near the bonding location 40*b*, forming an end 21*b*. The cutting step is preferably carried out so that the end 21*b* is at the same location as the first end 21*a*, as shown by the arrow of FIG. 7. The relationship between the ends 21*a* and 21*b* of the belt-shaped body 21 will be described below.

Although the bonding at location 40*b* may take place while the belt is in tension between the supply winding mechanism and the guide rolls GR, it is also permissible for end 21*b* to be integrally bonded to the belt-shaped body 21 after a belt-shaped body 21 is cut. The above-described series of operations produces a partial base 22, as shown in FIG. 8.

Figure 9:
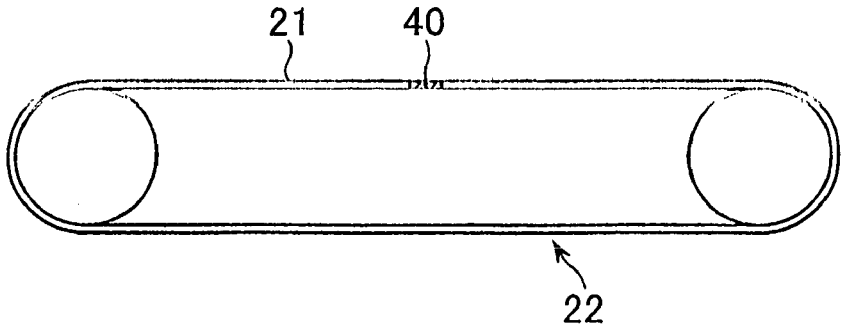
FIGS. 9–12 are schematic views illustrating a method of forming a partial base of a papermaking press felt in accordance with another embodiment of the invention.

Although FIGS. 4–8 show a partial base 22 produced by winding a belt-shaped body 21 a plurality of times, the invention is not limited to this structure. For example, a partial base 22 may be produced by integrally bonding ends 21*a* and 21*b* when butted against each other at a bonding location 40 as shown in FIG. 9, and forming a single-layer, belt-shaped body.

Figure 10:
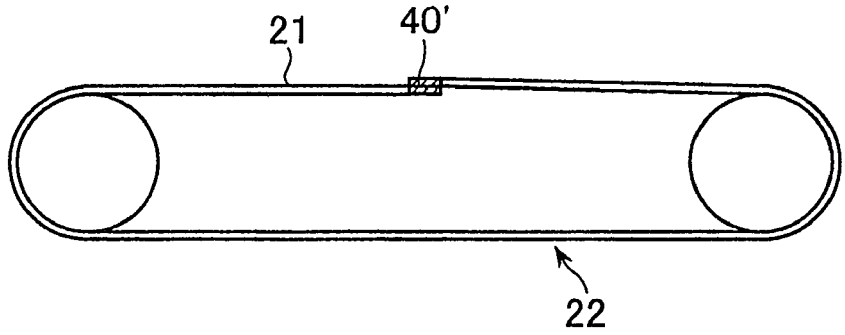

As an alternative, a single-layer partial base 22 may also be formed also by overlapping and integrally bonding the ends of a length of belt-shaped body at a bonding location 40' as shown in FIG. 10.

Figure 11:
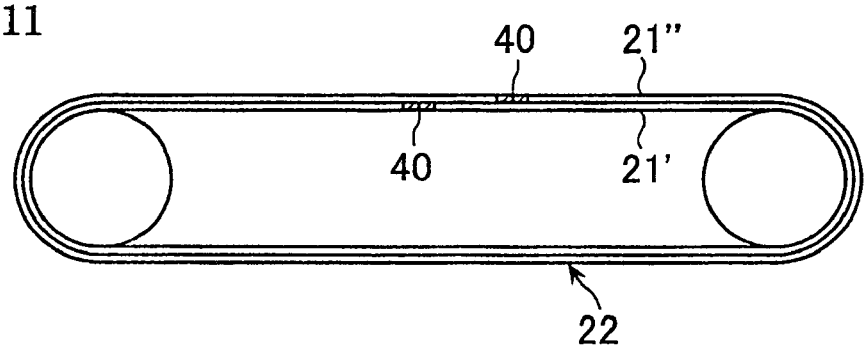

A plurality of endless belt-shaped bodies may be overlaid to form a multi-layer partial base. FIG. 11 shows an example that a partial base 22 produced by overlaying two endless belt-shaped bodies 21', 21", each having abutting ends. In this case, physical properties of the outer belt-shaped body 21" may differ from those of the inner belts-haped body 211 in order to obtain desired characteristics for the papermaking press felt.

Figure 12:
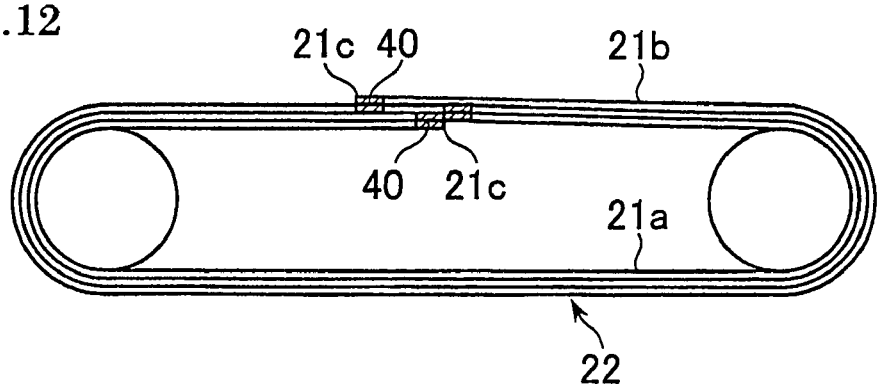

While FIG. 11 shows a partial base comprising single-layer belt-shaped bodies 21' and 21", each having abutting ends, various alternative structures can be adopted. For example, as shown in FIG. 12, a single-layer, endless belt-shaped body 21*b* may be combined, in overlaying relationship, with an endless belt-shaped body 21*a*, comprising a plurality of windings. In the case where plural endless belt-shaped bodies having overlapping ends are overlaid in this way, the end locations 21*c*, which are defined as the locations at which the ends of a length of a given belt are situated, should not coincide with, or overlap end areas of other belts of the combination.

Figure 13:
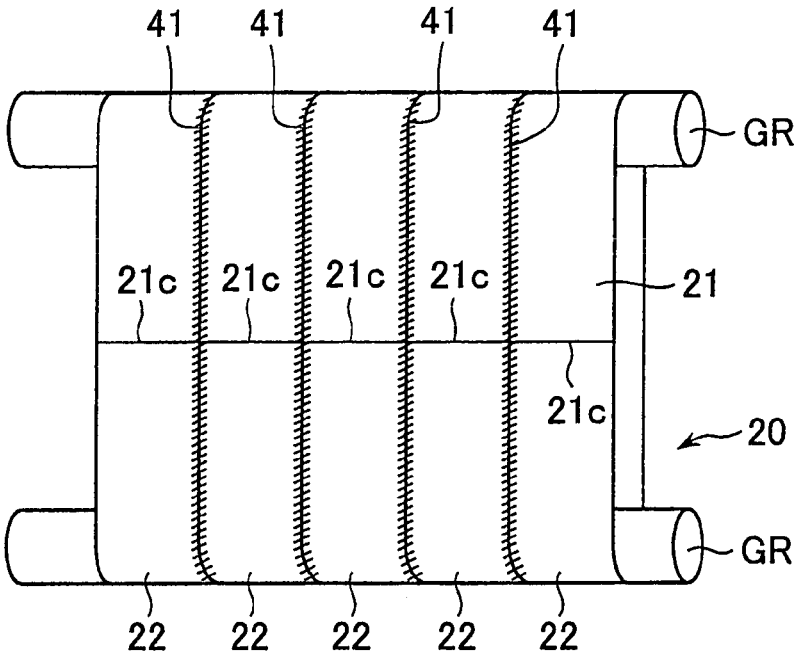
FIG. 13 is a top plan view of a base of a papermaking press felt in accordance with the invention.

As explained above, a belt-shaped body 21 of the invention is formed by combining plural partial base bodies 22. As shown in FIG. 13, side-by-side partial base bodies 22 are integrated by connecting their sides 41 to produce a base 20. After a base 20 having a desired width is formed, a batt fiber is intertwined with the outer and inner surfaces of the base 20 by needle punching to produce a papermaking press felt according to the invention.

Sewing by a soluble or insoluble fiber, bonding by deposition of an adhesive, or other forms of bonding may be used to connect the sides 41 of the partial base bodies 22. In the case of a water-soluble fiber, differences in the physical properties of the connected edges of the partial base bodies 22 and other parts of the partial bases are decreased, since the water-soluble fibers are dissolved after the manufacture of the felt is completed, just as in the case where soluble threads are used to sew the end of a belt-shaped body at a bonding location 40*a*. Even though the water-soluble fiber is dissolved, the sides of partial base bodies 22 are connected strongly as a result of the needling operation used to integrate the batt fiber with the base. In other words, the surfaces of adjacent partial base bodies are connected to each other by virtue of their being integrated with batt fibers, which are strongly intertwined with the base fabric by needling. Accordingly, even after water-soluble fiber, initially used to connect adjacent partial base bodies, is dissolved, the sides of partial base bodies 22 remain connected.

The relationship between ends 21*a* and 21*b* of a belt-shaped body 21 in a partial base 22 will be explained with reference to FIGS. 14 and 15. As explained above, ideally ends 21*a* and 21*b* are directly opposite each other on opposite sides of the partial base 22. However, it is very difficult to realize this structure in practice. Therefore, the relationship between the ends 21*a* and 21*b* is either one wherein they overlap, as shown in FIG. 14, or one wherein there is a gap between the locations of ends 21*a* and 21*b* along the length of the belt-shaped body as shown in FIG. 15, so that the ends face each other.

Figure 14:
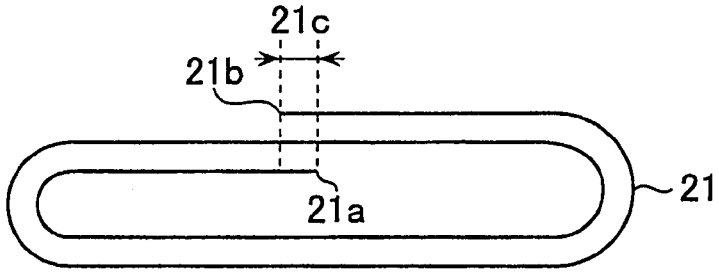
FIG. 14 is a schematic view showing the end area of a papermaking press felt according to an embodiment of the invention.
Figure 15:
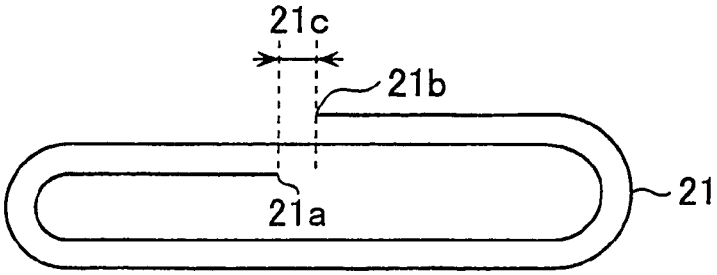
FIG. 15 is a schematic view showing another end area structure in a papermaking press felt according to the invention.

To impart maximum strength to a papermaking press felt, it is preferable that the end portions of the belt-shaped body overlap over an area 21*c*, which is defined between the locations of ends 21*a* and 21*b* along the length of the belt, as shown in FIG. 14. Where the belt-shaped body 21 is a woven fabric, and has an area 21*c* as shown in FIG. 14, it is desirable that the density of the weft adjacent both ends 21*a* and 21*b*, within area 21*c* be small. The physical properties and thickness of the entire partial base 22 may then be kept uniform, since the warps can be interwind with each other within area 21*c*. On the other hand, in the case where both ends 21*a* and 21*b* face each other, with a gap between them, as shown in FIG. 15, it is preferable to keep the gap as short as possible, that is, to shorten the distance between ends 21*a* and 21*b*. In the case where ends 21*a* and 21*b* abut each other at bonding location 40, as shown in FIG. 9, the belt-shaped the bonding location 40 corresponds to area 21*c*.

Figure 16:
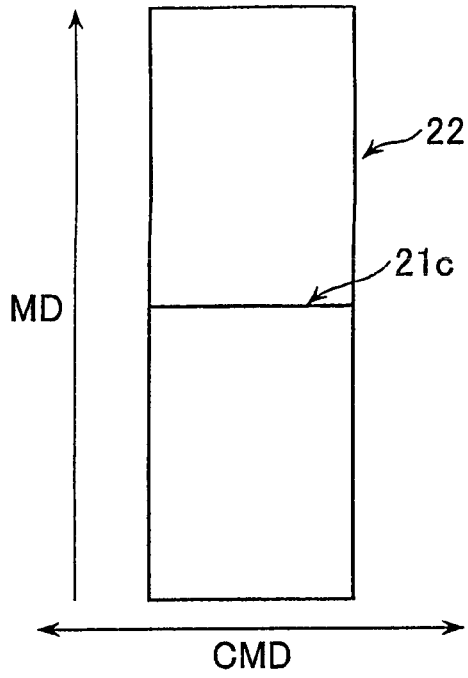
FIG. 16 is a top plan view of a partial base wherein the end area is formed so that it is parallel with the cross machine direction.
Figure 17:
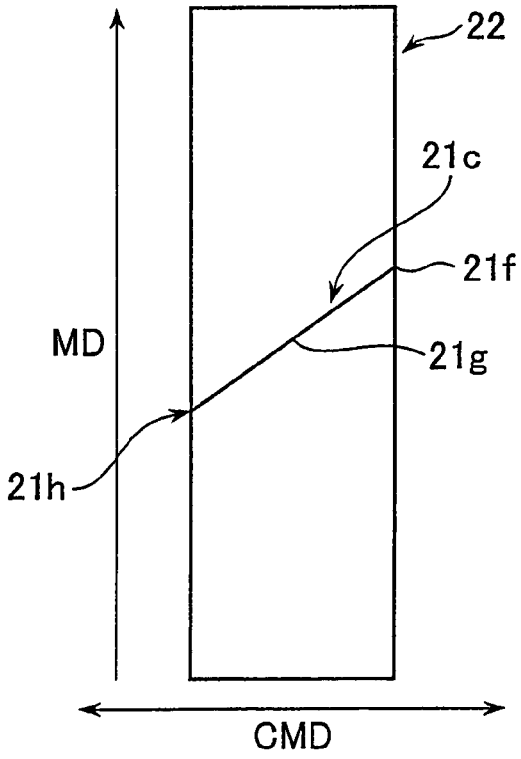
FIG. 17 is a top plan view of a partial base wherein the end area is formed so that it is disposed at an angle relative to the cross machine direction.

The structure of an end area 21*c* in a partial base body 22 will be further explained with reference to FIG. 16 and FIG. 17. The end area 21*c* may be disposed in parallel with a cross machine direction as shown in FIG. 16. Alternatively, by adjusting the cutting angle of both ends 21*a* and 21*b*, the end area 21*c* can be disposed at an angle relative to a cross machine direction, as shown in FIG. 17.

Whether the end area 21*c* should be parallel to the cross machine direction, or at an angle relative to the cross-machine direction, is determined by considering the structure of the press part of a papermaking machine in which a felt is to be used, and the desired function of the felt. When an end area 21*c* is parallel with the cross machine direction, there is an advantage in that manufacture may be carried out more easily. However, when the end area 21*c* is at an angle relative to a cross machine direction, oscillation of the papermaking press felt is reduced, since the front section 21*f* of the end area 21*c* enters the press nip first, followed by the inclined part 21*g*, and finally by section 21*h*.

The placement of a plurality of end areas 21*c* in the base 20 will be explained with reference to FIG. 13 and FIGS. 18–23. In FIG. 13, the end areas 21*c* of the partial base bodies 22 are in parallel with a cross machine direction and on the same straight line in the cross machine direction. In the use of a felt having a base structure as shown in FIG. 13, all the end areas 21*c* enter the press nip at the same time. Therefore, there is a possibility that this placement of the end areas 21*c* causes trouble in the operation of the papermaking machine. For example, oscillation of the rolls of the papermaking machine, and oscillation of the papermaking press felt, may result. Accordingly, this placement is not preferred. Structures in which the end areas 21*c* are not on the same line in the cross machine direction are preferred in order to avoid such a situation.

Examples of structures in which the end areas 21*c* are not aligned with one another in the cross-machine direction are shown in FIGS. 18–23. It should be understood that, while no two end areas 21*c* in the following explanatory views are on the same line in the cross machine direction, it is possible to realize the advantages of avoiding cross-machine alignment of the end areas 21*c* to some extent even in the case where some of end areas 21*c* are on the same line in the cross machine direction.

Figure 18:
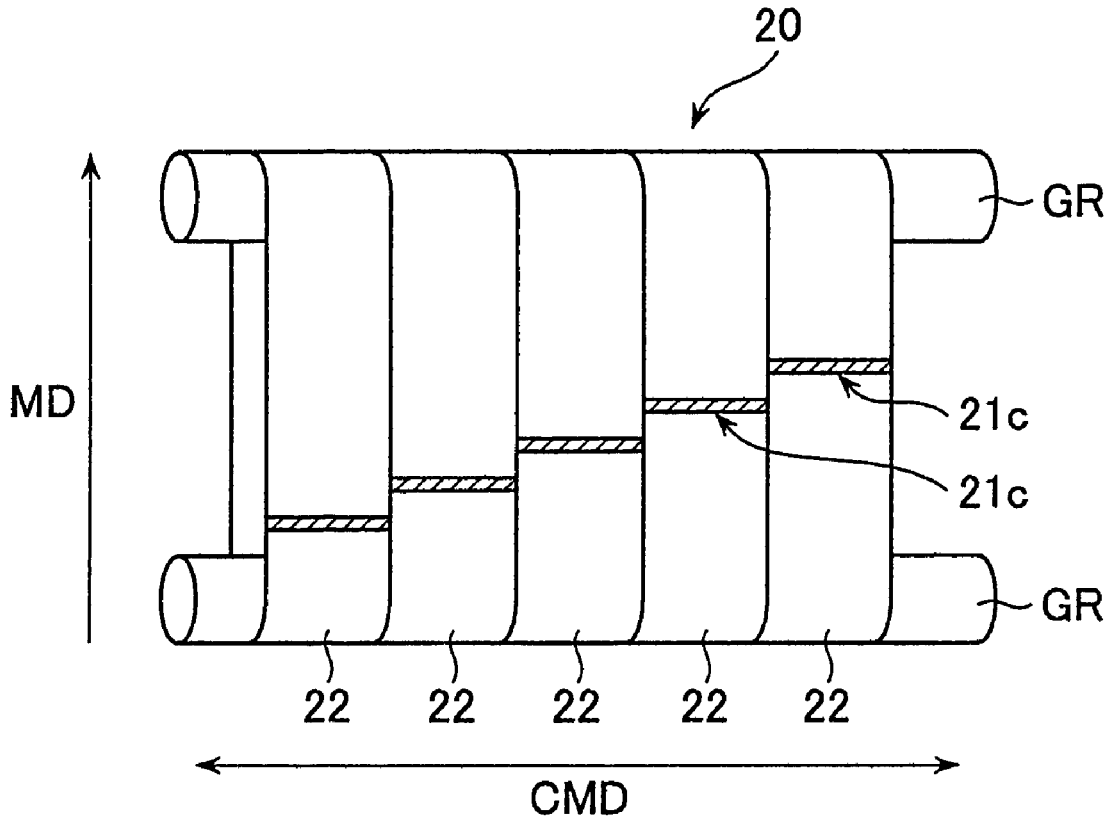
FIG. 18 is a top plan view of the base of a papermaking press felt in accordance with another embodiment of the invention.
Figure 19:
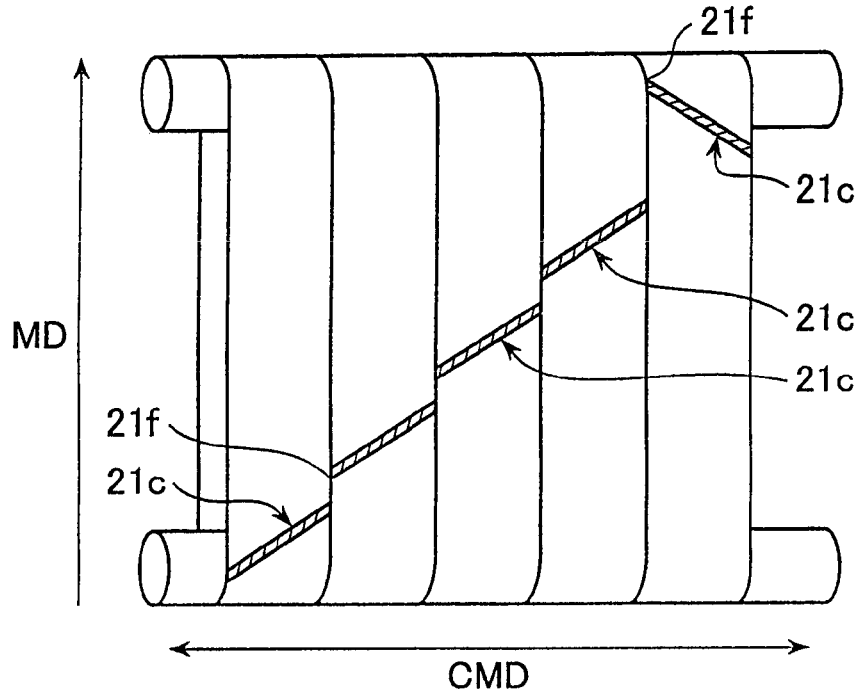
FIG. 19 is a top plan view of the base of a papermaking press felt in accordance with still another embodiment of the invention.
Figure 20:
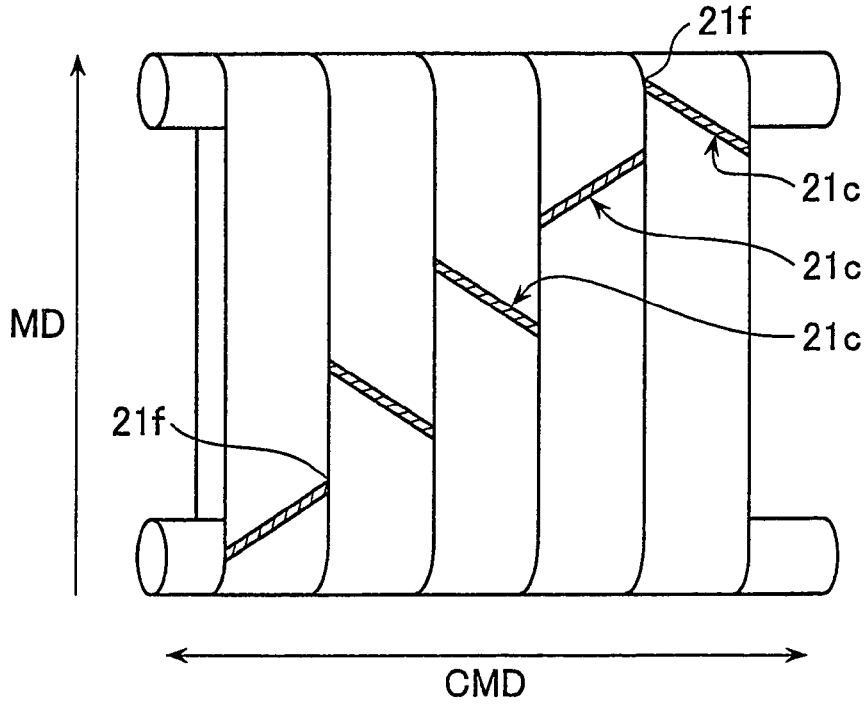
FIG. 20 is a top plan view of the base of a papermaking press felt in accordance with still another embodiment of the invention.

FIGS. 18–20 show examples of end areas 21*c* which are shifted relative to one another in the machine direction. FIG. 18 shows the case where all end areas 21*c* are in parallel with the cross machine direction, and shifted in progressive steps along the machine direction. FIGS. 19 and 20 show cases where all end areas 21*c* are disposed at angles relative to the cross machine direction. The structure of the end areas 21*c* in FIGS. 19 and 20 is superior to that of FIG. 18 in preventing roll oscillation in a papermaking machine and oscillation of the papermaking press felt.

In FIGS. 19, 20, 22, and 23, end areas 21*c* located at both sides of a base 20, i.e., on the outermost belt-shaped partial base bodies, are disposed at an angle relative to a cross machine direction. In this case, it is desirable that the front sections 21*f* of the end areas 21*c* on both sides of the base 20 be provided on the inside rather than at the edge of the base, that is, on the inboard sides of the outermost partial base bodies. Normally, a guide in a papermaking machine is in contact with the sides so that the traveling position of a papermaking press felt is controlled. When front sections 21*f* of the end areas 21*c* on both sides of the base 20 are provided on the outsides of the base, they comes into contact with the guide at an acute angle relative to a running direction of a front sections 21*f*. Therefore, there is a possibility that a front section 21*f* which contacts the guide repeatedly will gradually peel off a partial base 22, resulting in damage to the press felt. This tendency to peel is avoided by positioning the front sections 21*f* inboard on both sides of the base.

Whereas in FIG. 19, all the end areas 21*c* except the rightmost are disposed in the same orientation relative to the cross machine direction, the end areas can be oriented in different directions as shown in FIG. 20.

In addition, since in a papermaking press felt of FIGS. 18-20, the end areas 21*c* are progressively shifted in the machine direction from one side of the base to the other, so that the areas 21*c* enter into the press nip successively from one side to the other side of the felt, there is a possibility that such a papermaking press felt will produce a driving force in the cross machine direction (e.g, the leftward direction in FIGS. 18–20), and as a result, deviation or meandering of the belt from its proper running path may occur.

Figure 21:
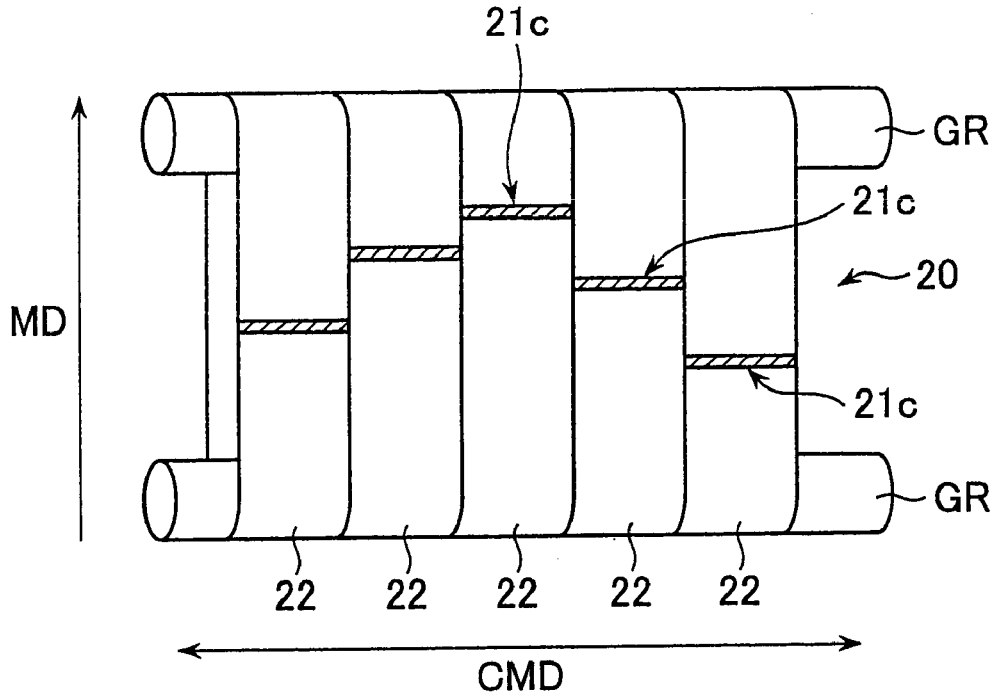
FIG. 21 is a top plan view of the base of a papermaking press felt in accordance with still another embodiment of the invention.
Figure 22:
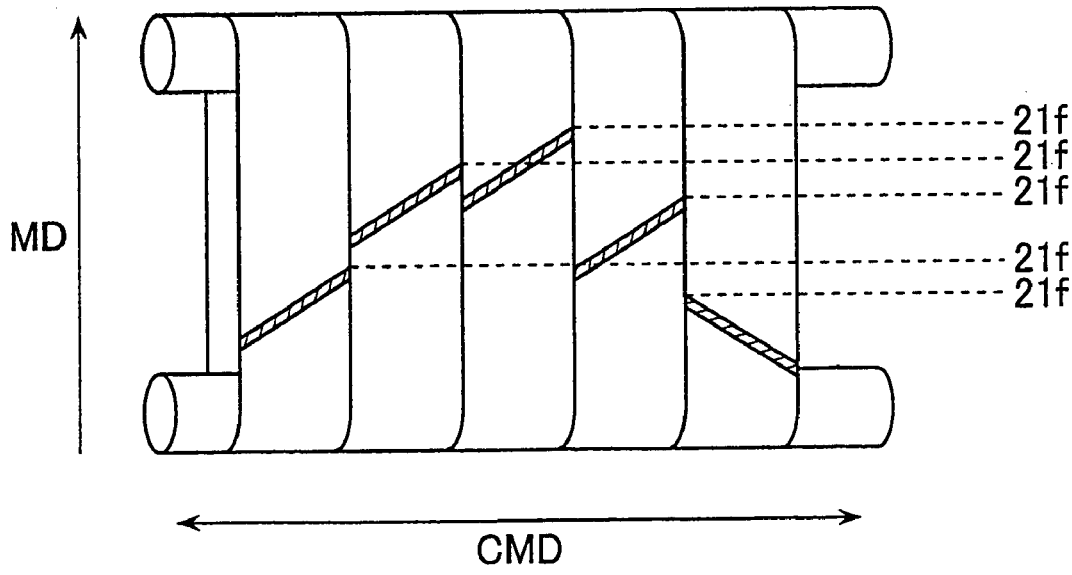
FIG. 22 is a top plan view of the base of a papermaking press felt in accordance with still another embodiment of the invention.
Figure 23:
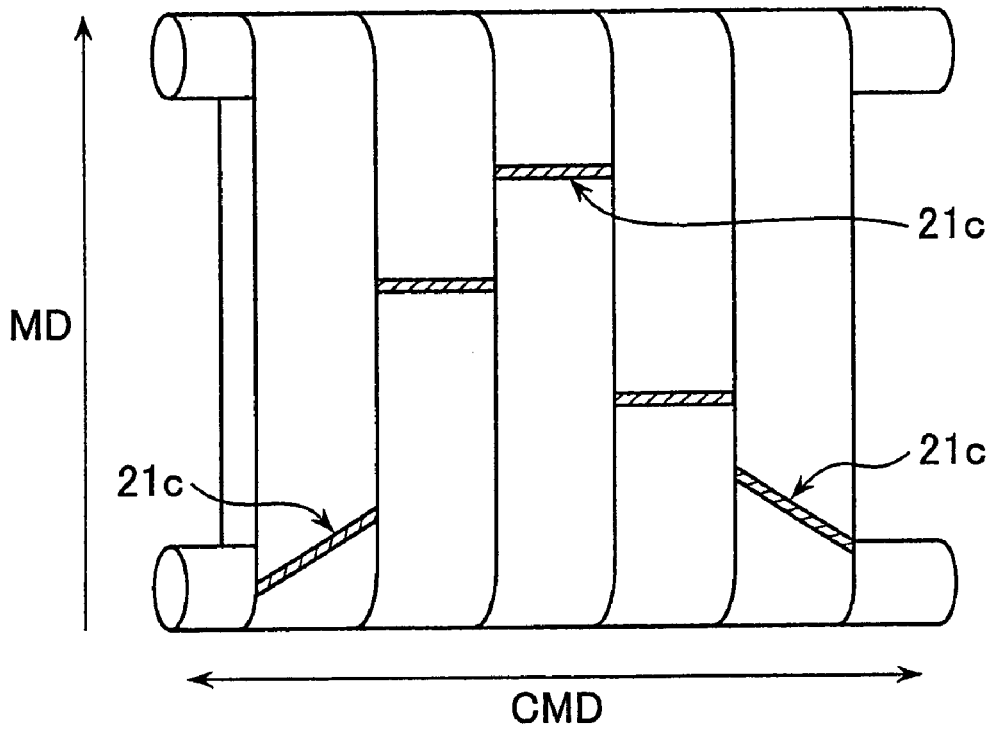
FIG. 23 is a top plan view of the base of a papermaking press felt in accordance with still another embodiment of the invention.

To solve this problem, it is preferable that end areas 21*c* on both sides of the base enter into the press nip later than the end areas 21*c* at intermediate locations on the base, as shown in FIGS. 21–23. In this way, not only is the meandering problem avoided, but, a widening effect is realized so that creases that may form in the papermaking press felt are removed by a driving force working from the inside toward the outside in the cross machine direction, which is generated as a result of the placement of the end areas 21*c*. This base structure, as depicted in FIGS. 21–23 supplements the crease-removing effect of an expander roll in a papermaking machine, and enables the expander roll to be simplified.

FIG. 22 illustrates an example of a relatively short press felt in which the end areas are concentrated within an area which is narrow in the machine direction. In a relatively short papermaking press felt such as this one, it is sometimes difficult to provide angled end areas which do not overlap in the cross machine direction. In such a case, the end areas should be positioned so that their front sections 21*f* are at different stations in the machine direction, and not on the same line in the cross machine direction, as shown in FIG. 22.

End areas 21*c* which are parallel to the cross machine direction and end areas 21*c* which are disposed at an angle relative to a cross machine direction, may be mixed, as shown in FIG. 23.

As explained above, according to the invention, a papermaking press felt of a desired size may be manufactured in a relatively short time, and with little manpower, since the base is formed by integrating partial base bodies in side-by-side relationship. In addition, since partial base bodies are lined up in the machine direction, rather than in a spiral at an angle relative to the machine direction as in the conventional case, separation of partial base bodies, lowering of bond strength, which accompanied separation, and resulting transfer of irregularities to a wet paper web, may be prevented.

What is claimed is:

1. A papermaking press felt comprising a base, and a batt layer which is integrated with said base, wherein the base comprises a plurality of partial base bodies, each partial base body being in the form of a closed loop and having a width narrower than the width of the press felt, said partial base bodies being disposed in side-by-side relationship with adjoining sides, and said adjoining sides being connected, the press felt having at least one intermediate partial base body and side partial base bodies disposed along the sides of the base, wherein each said partial base body is composed of a belt-shaped body having ends which are integrally bonded to each other in an end area, and wherein the end area of each intermediate base body is located in front of the end areas of both of the side partial base bodies relative to a machine direction, whereby, in the operation of the press felt, the entry of all end areas of all intermediate partial base bodies of the press felt into a press nip is followed in sequence by the entry of both of the end areas of the side partial base bodies into the press nip.

2. A papermaking press felt as claimed in claim 1, wherein said end areas of the side partial base bodies are disposed at acute angles relative to the cross machine direction, whereby each said end area of a side partial base body has a front section located ahead of the other parts thereof relative to the machine direction, and wherein said end areas of the side partial base bodies overlap each other in the machine direction, but the front sections of said end areas of the side partial base bodies are offset from each other in the machine direction.

3. A papermaking press felt comprising a base, and a batt layer which is integrated with said base, wherein the base comprises a plurality of partial base bodies, each partial base body being in the form of a closed loop and having a width narrower than the width of the press felt, said partial base bodies being disposed in side-by-side relationship with adjoining sides, and said adjoining sides being connected, the press felt having side partial base bodies disposed along the sides of the base, wherein each said partial base body is composed of a belt-shaped body having ends which are integrally bonded to each other in an end area, wherein said end areas of the side partial base bodies are disposed at acute angles relative to the cross machine direction, wherein each said end area of the side partial base bodies has a front section located ahead of the other parts thereof relative to the machine direction, and wherein the front sections of the end areas of both said side partial base bodies are located inboard of the base.

* * * * *